US006787721B1

(12) United States Patent
Huang

(10) Patent No.: US 6,787,721 B1
(45) Date of Patent: Sep. 7, 2004

(54) SAFETY SWITCH OF SCREWDRIVER

(76) Inventor: Wen-Sheng Huang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/740,037

(22) Filed: Dec. 19, 2003

(51) Int. Cl.[7] ..... H01H 9/20

(52) U.S. Cl. ..... 200/334; 200/43.11; 200/43.17; 200/522; 83/471.2; 30/381

(58) Field of Search ..... 200/334, 332.2, 200/43.11, 43.17, 43.18, 329, 522, 51 LM, 293.1; 83/471.2, 471.3; 30/381, 382

(56) References Cited

U.S. PATENT DOCUMENTS 3,873,796 A * 3/1975 Worobec, Jr. ..... 200/332.2
4,381,037 A * 4/1983 Cuneo ..... 173/170
4,598,182 A * 7/1986 Breslin ..... 200/43.11
4,922,069 A * 5/1990 Huizenga ..... 200/334
5,577,600 A * 11/1996 Schoene et al. ..... 200/43.17
5,638,945 A * 6/1997 Fukinuki et al. ..... 200/43.17
6,538,128 B1 * 3/2003 Zhang et al. ..... 536/25.3
6,610,946 B2 * 8/2003 Covell et al. ..... 200/321

* cited by examiner

*Primary Examiner*—Kyung Lee

(57) ABSTRACT

A safety switch of a screwdriver has a driver body. The safety switch of a screw comprises a push unit; a trigger pivotally installed on the driver body; a receiving space being formed within the trigger for receiving the push unit; a safety rod; one end of the safety rod being installed at a lower end of the driver body; and another end of the safety rod being installed below the trigger. The push unit comprises: a torsion spring and a resisting unit pivotally installed to the trigger; one end of the torsion spring resisting against the resisting unit; and a roller pivotally installed to the trigger and installed at a pushed end of a valve rod. By above structure, the screwdriver can be operated safety by controlling the actuation of the safety rod.

1 Claim, 5 Drawing Sheets

SAFETY SWITCH OF SCREWDRIVER

FIELD OF THE INVENTION

The present invention relates to screwdrivers, and particular to a safety switch of a screwdriver which has a sample and easily assembled structure. Moreover, the safety switch can be used safely.

BACKGROUND OF THE INVENTION

Screwdrivers are general tools for the carpenters and currently they become more useful for DAY (do-it-yourself) workers. In the prior art, the main concern in designing screwdrivers is the speed and convenience of the screwdriver, but recently, the safety use of screwdrivers becomes more and more important in design of the screwdrivers.

In one prior art, a slide seat is used to control the movement of a turning unit so as to control the triggering operation of the trigger by a first flange on the turning unit, thereby, a predetermined effect is acquired. In another prior art, a sliding seat resists against and rotates an elastomer 44 so that a buckling portion will shift a stop to rotate through a predetermined angle and thus the body of the screwdriver will trigger the trigger to have a predetermined effect.

In above said prior arts, there are so many components to make the structure too complicate. Thereby, the cost is high and the assembly work is tedious. As a result the yield ratio is low.

SUMMARY OF THE INVENTION

Accordingly, the primary object of the present invention is to provide a safety switch of a screwdriver which has a sample and easily assembled structure. Moreover, the safety switch can be used safety.

To achieve above object, the present invention provides a safety switch of a screwdriver having a driver body; the safety switch comprising: a push unit; a trigger pivotally installed on the driver body; a receiving space being formed within the trigger for receiving the push unit; a safety rod; one end of the safety rod being installed at a lower end of the driver body; and another end of the safety rod being installed below the trigger; the safety rod being movable into or out of the trigger for pushing the push unit. The push unit comprises: a torsion spring pivotally installed to the trigger; a resisting unit pivotally installed to the trigger; one end of the torsion spring resisting against the resisting unit and another end thereof enclosing a pin which is pivotally installed to the trigger; the ejecting unit having two ends; and a roller pivotally installed to the trigger and installed at a pushed end of a valve rod;

When the trigger is triggered firstly without pushing the safety rod, the roller will move and rotate to leave the push end of the valve rod so that the valve rod cannot be pushed and the screwdriver will not be triggered. When the safety rod is pushed firstly, the safety rod will resist against one end of the resisting unit so that another end of the resisting unit resists at one side of the roller. When the trigger is pressed, the roller cannot rotate because the roller is resisted against by resisting unit. Thus, the roller moves toward the pushed end of the valve rod so that the screwdriver is triggered.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
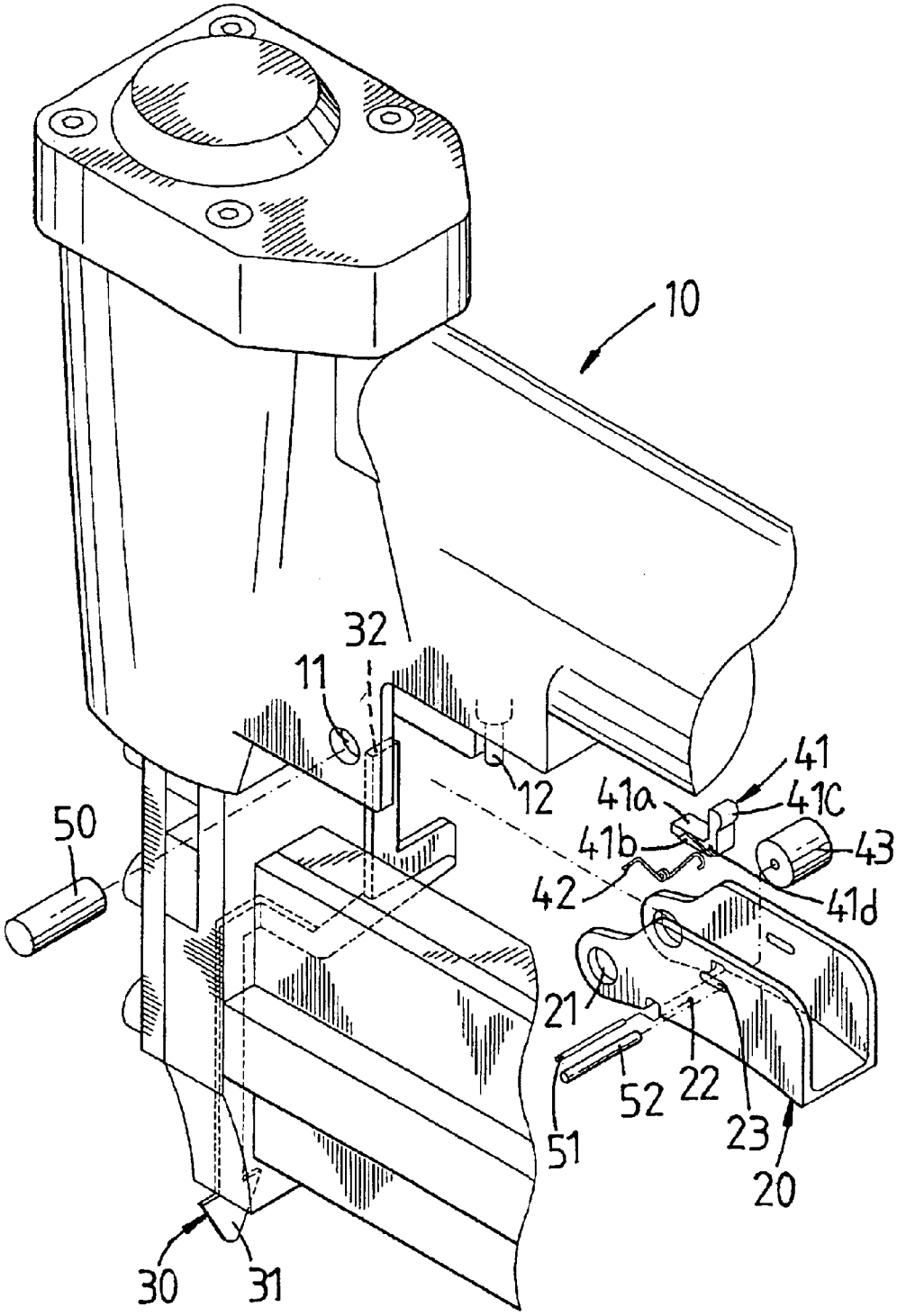
FIG. 1 is a structural exploded view about the safety switch of a screwdriver of the present invention.
Figure 2:
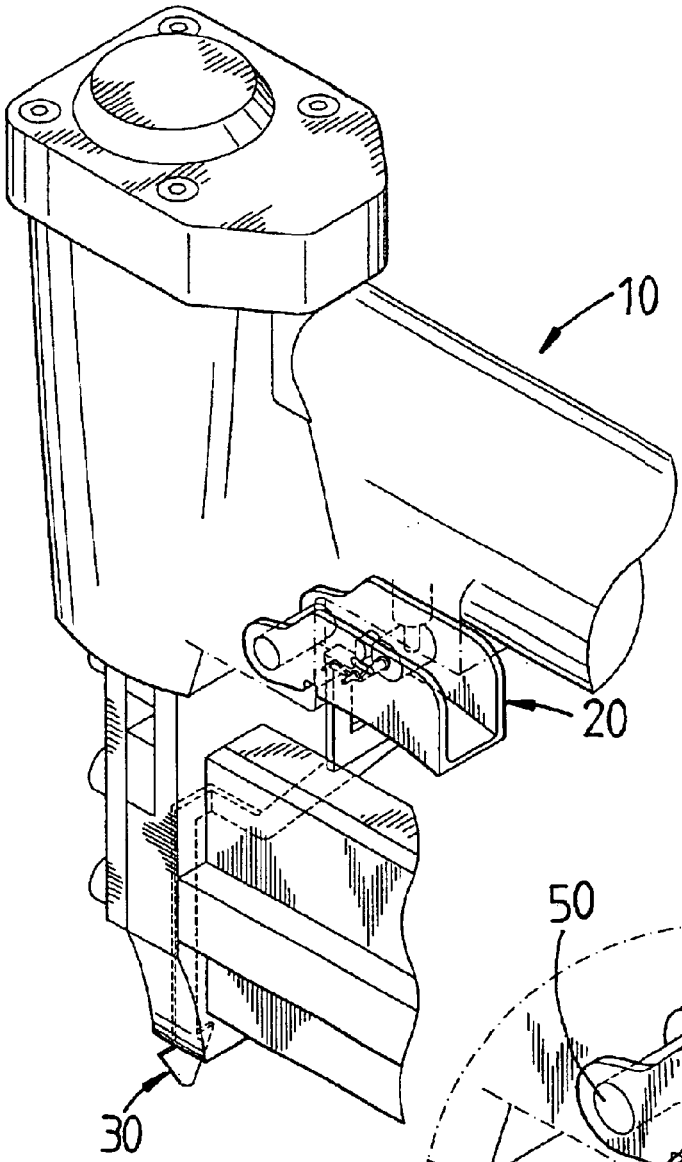
FIG. 2 is a perspective view of the safety switch of the present invention.
Figure 3:
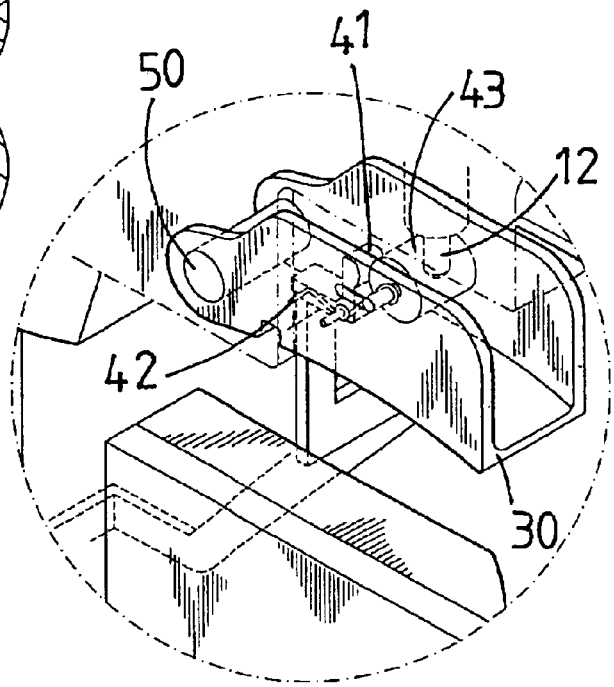
FIG. 3 is a partial perspective view of the safety switch of the present invention.

With reference to FIGS. 1 and 3, the safety switch of a screwdriver of the present invention is illustrated. The safety switch includes a driver body 10, a trigger 20, a safety rod 30, and a push unit 40.

The trigger 20 is pivotally installed on the driver body 10. A receiving space is formed within the trigger 20 for receiving the push unit 40. Each of two sides of the trigger 20 has a first through hole 21 and a second through hole 22. The trigger 20 is pivotally installed to the driver body 10 by passing a first positioning stud 50 through the first through hole 21 and second positioning holes 11 in the driver body 10. A slot 23 is installed behind the first and the second through holes 21 and 22.

The safety rod 30 contains a touch end 31 and a push end 32. The touch end 31 is installed at a lower end of the driver body 10. The push end 32 is installed below of the trigger 20. The push end 32 is movable into and out of the trigger 20 for pushing the push unit 40.

The push unit 40 is installed by a resisting unit 41, a torsion spring 42, and a roller 43. The resisting unit 41 has an L shape. One end of the resisting unit 41 is a stop end 41*a* for resisting against the safety rod 30 and another end thereof is a resisting end 41*c* for resisting the roller 43. A block 41*b* protrudes from a lateral side of the stop end 41*a*. A third through hole 41*d* is formed in the push unit 40. The push unit 40 with the torsion spring 42 is fixed to the trigger 20 by using a second positioning stud 51 through the second through hole 22 and the third through hole 41*d*. One end of the torsion spring 42 resists against the block 41*b* and another end thereof resists against a pin 52 for pivotally installing the trigger 20 and the roller 43. A center of the roller 43 is a fourth through hole 43*a*. The roller 43 is installed below a pushed end of a valve rod of the driver body 10 which can be pushed to move the valve rod to trigger the screwdriver.

The main feature of the present invention is the rolling operation of the roller 43 on the push unit 40. When the trigger 20 is triggered, the roller 43 will touch a valve rod 12 on the driver body 10, the roller 43 will move and roll at a pushed end at the same time. If the pushed end is ejected, the valve rod 12 will move upwards so as to trigger the screwdriver to actuate the beating of a nail. If no other external force is applied, the roller 43 will roll to be aside of the valve rod 12. Besides, when the trigger 20 is triggered, the torsion spring 42 will be compressed to absorb a part of elastic potential. Thereby, when the trigger 20 is released, the elastic potential will be released so as to restore to the original position. As a result the trigger 20 will restore to the original position.

Figure 4:
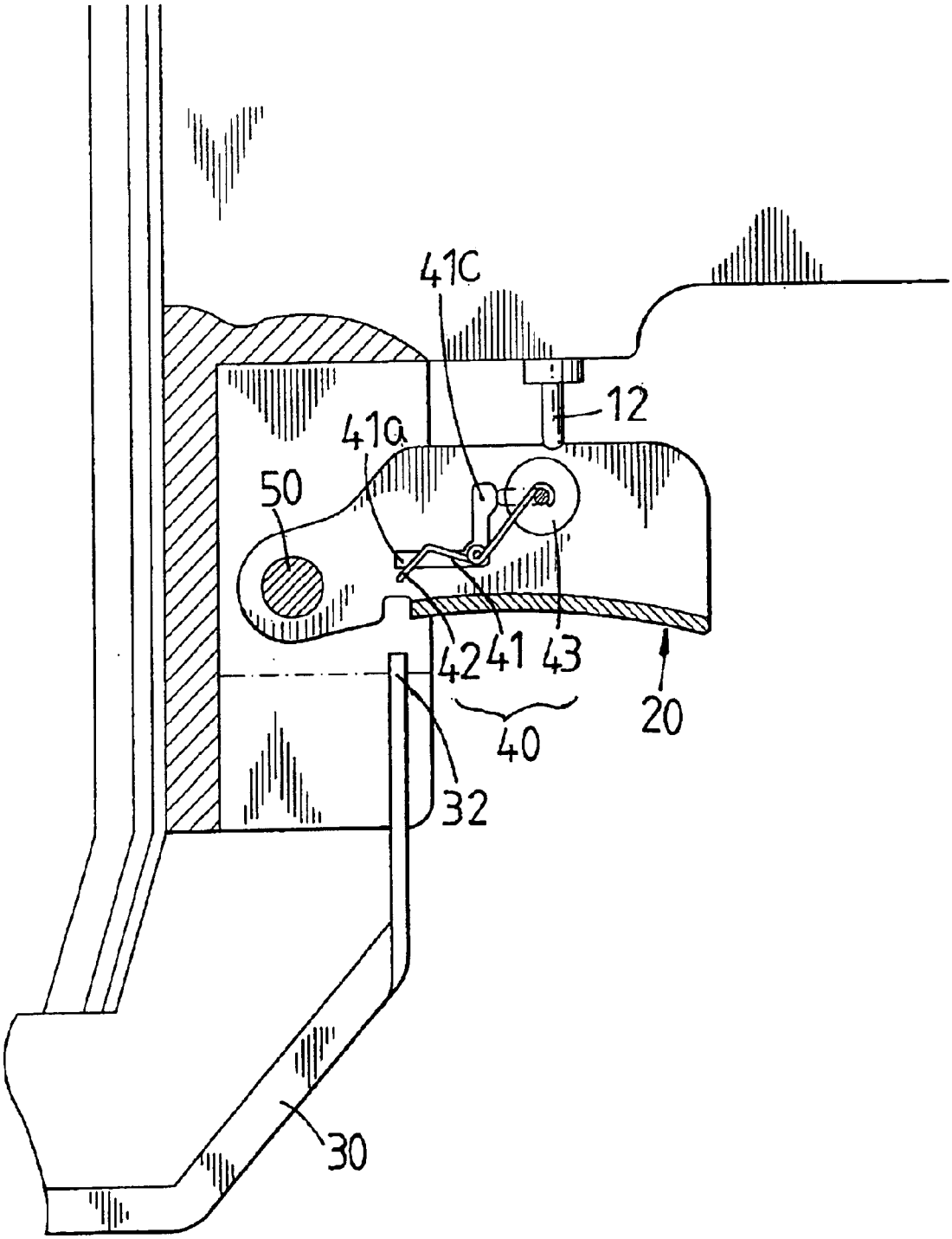
FIGS. 4 to 6 shows the operation of the safety switch of a screwdriver of the present invention.
Figure 5:
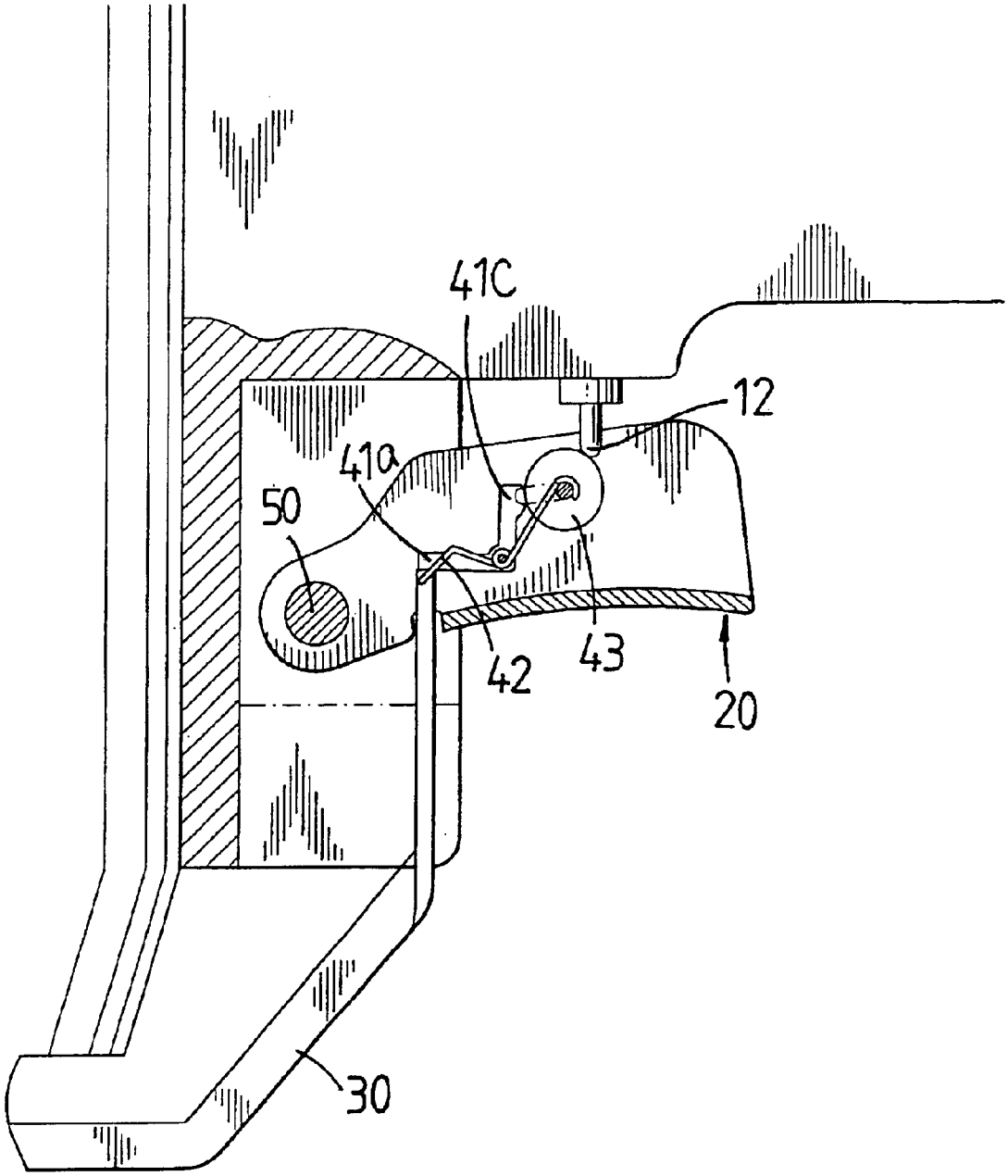
Figure 6:
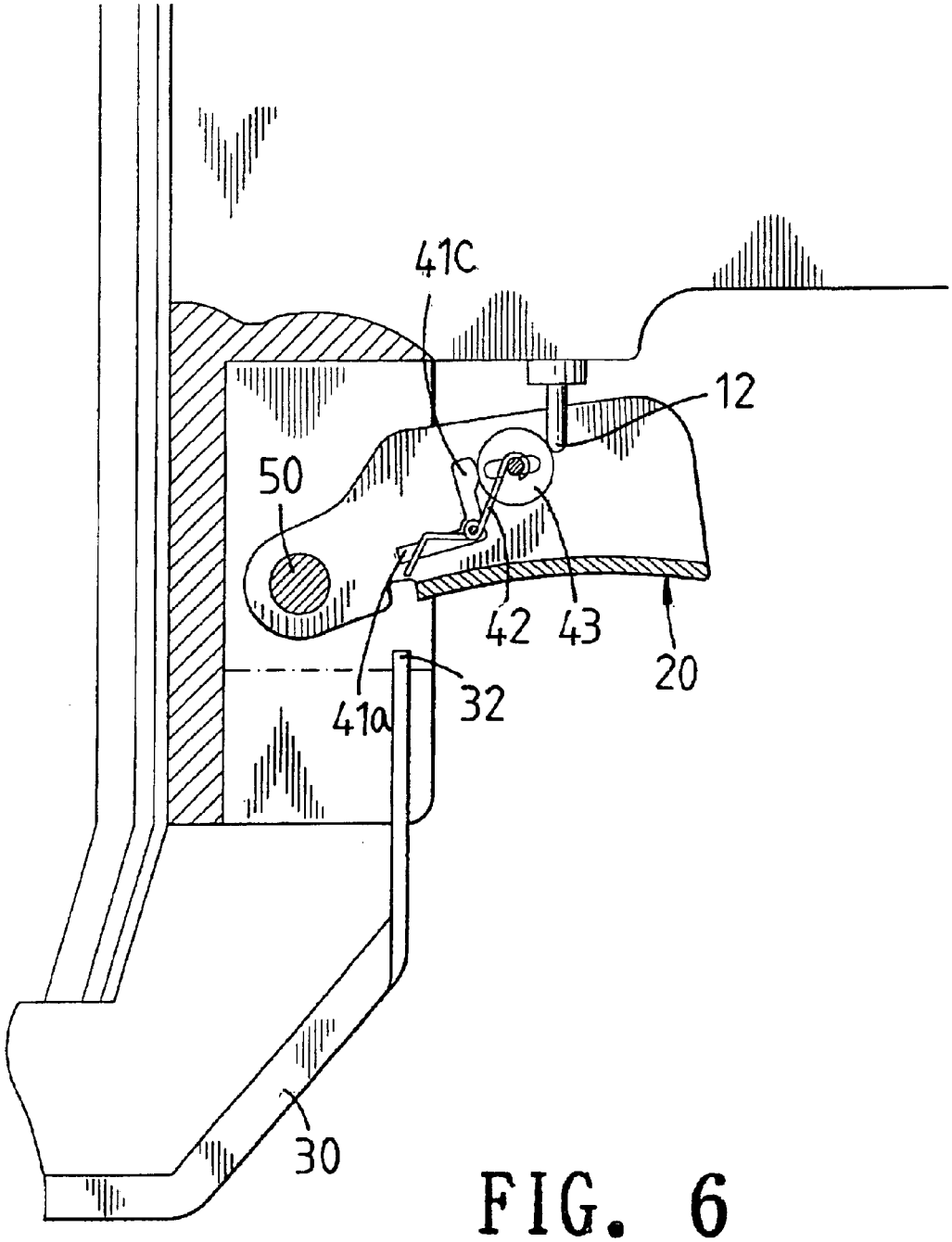

Referring to FIGS. 4 to 6, the operation of the present invention will be described. The touch end 31 of the safety rod 30 is pressed upwards, see FIG. 5. The push end 32 moves upwards to resist against the stop end 41*a* of the resisting unit 41 so that the resisting end 41*c* resists at the right side of the roller 43. When the trigger 20 is pressed, since the roller 43 is resisted by the resisting end 41*c* so that it cannot rotate, the roller 43 moves toward the valve rod 12 so that the screwdriver is triggered.

With reference to FIG. 6, when the trigger 20 is pressed firstly without pressing the safety rod 30, the roller 43 will roll to be at the right side of the valve rod 12 so that it cannot move the valve rod 12. At this moment, the resisting unit 41 will be pushed upwards along a counterclockwise direction. At this moment, when the safety rod 30 is pressed, the roller 43 just resists the lateral side of the valve rod 12 which does not move upwards so that the screwdriver cannot be triggered.

As above mentioned, in the present invention, by the roller 43, the resisting unit 41, and the torsion spring 42, the present invention can be assembled easily and rapidly. As a result, the cost is reduced and the yield ratio is improved. In the present invention, by the principle of dynamics and elastic potential of the elastomer, the object of safety operation is achieved.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A safety switch of a screwdriver; the screwdriver having a valve rod; the valve rod has a pushed end; by pushing the pushed end, the valve rod will move to trigger the screwdriver to driver nails; the screwdriver having a driver body; the safety switch comprising:

a push unit;

a trigger pivotally installed on the driver body; a receiving space being formed within the trigger for receiving the push unit;

a safety rod; one end of the safety rod being installed at a lower end of the driver body; and another end of the safety rod being installed below the trigger; the safety rod being movable into or out of the trigger for pushing the push unit;

wherein the push unit comprises:

a torsion spring pivotally installed to the trigger;

a resisting unit pivotally installed to the trigger; one end of the torsion spring resisting against the resisting unit and another end thereof enclosing a pin which is pivotally installed to the trigger; the resisting unit having two ends; and a roller pivotally installed to the trigger and installed between one end of the resisting unit and a pushed end of the valve rod;

wherein when the trigger is triggered firstly without pushing the safety rod, the roller will move and rotate to leave the push end of the valve rod so that the valve rod can not be pushed and the screwdriver will not be triggered;

when the safety rod is pushed firstly, the safety rod will resist against one end of the resisting unit so that another end of the resisting unit resists at one side of the roller; when the trigger is pressed, the roller cannot rotate because the roller is resisted by resisting unit. Thus, the roller pushes the pushed end of the valve rod so that the screwdriver is triggered.

* * * * *